US007229335B2

(12) United States Patent
Davis

(10) Patent No.: US 7,229,335 B2
(45) Date of Patent: Jun. 12, 2007

(54) ADHESIVE BRA WITH IMPROVED BREATHABILITY

(75) Inventor: Theodore L. Davis, Becket, MA (US)

(73) Assignee: Brazabra Corporation, Lee, MA (US)

( * ) Notice: Subject to any disclaimer, the term of this patent is extended or adjusted under 35 U.S.C. 154(b) by 120 days.

(21) Appl. No.: 11/110,065

(22) Filed: Apr. 20, 2005

(65) Prior Publication Data

US 2006/0252342 A1 Nov. 9, 2006

(51) Int. Cl.
*A41C 3/12* (2006.01)
*A41C 3/06* (2006.01)

(52) U.S. Cl. ..... 450/81; 450/54; 450/57

(58) Field of Classification Search ..... 450/37.39, 450/54–57, 81; 2/267, 268; 623/7, 8; 604/385.07; 128/890, 889; 602/41–45, 47, 54, 55, 57, 602/58, 59, 60, 61
See application file for complete search history.

(56) References Cited

U.S. PATENT DOCUMENTS 2,793,369 A * 5/1957 Panighini ..... 450/53
4,333,471 A * 6/1982 Nakai ..... 450/81
4,640,288 A * 2/1987 Hattori ..... 450/81
6,156,065 A 12/2000 Eaton
6,241,998 B1 * 6/2001 Muchin ..... 424/448
6,299,505 B1 * 10/2001 Huang ..... 450/57
6,645,042 B2 11/2003 Davis
D485,965 S 2/2004 Slimak et al.
2003/0139720 A1 7/2003 Nordness et al.
2003/0220048 A1 11/2003 Toro et al.

OTHER PUBLICATIONS

U.S. Appl. No. 10/869,442, filed on Jun. 16, 2004 in the name of Theodore Davis.
Pe Hygiene Bags Exporter, Indevco Group Export Division, tradeindia.com, <www.tradeindia.com/TradeLeads/sell/lead_details.html?lead_id=378718>.

* cited by examiner

*Primary Examiner*—Gloria M. Hale
(74) *Attorney, Agent, or Firm*—Cowan, Liebowitz & Latman, PC

(57) ABSTRACT

An adhesive bra element comprising a breathable member to be used as a bra cup and having a plurality of though openings over a predetermined area of the breathable member to provide breathability, wherein the through openings are slit openings.

29 Claims, 2 Drawing Sheets

ADHESIVE BRA WITH IMPROVED BREATHABILITY

BACKGROUND OF THE INVENTION

This invention relates to an adhesive bra and, more particularly, to an adhesive bra with improved breathability.

It is desirable in the selection of undergarments to have a bra which provides support for a user's breasts and which would not become obviously visible when the user wears sheer or revealing clothing. Adhesive bras are well known in the art and often have a less conspicuous appearance or outline when worn by the user. Conventional adhesive bras comprise two cups each cup being formed from a porous cup member with an adhesive coating disposed on one side, or a portion of one side, of the porous member for securing the cup member to the user's skin. Examples of typical adhesive bras are disclosed in commonly-assigned U.S. Pat. Nos. D485,965 and 6,645,042.

While it is aesthetically desirable that the user's bra remain concealed from view, it is also essential for the safety and comfort of the user to have a bra that is breathable. Conventional adhesive bras typically have limited breathability as a result of the adhesive coating disposed on the cup member. In particular, even if the cup member is porous and has breathable properties, the adhesive coating blocks the pore openings on the surface of the cup member and impedes the air exchange between the user's skin and the atmosphere. The lack of breathability of the bra often causes its user to experience great discomfort, such as itching, blisters and other skin irritation problems.

To improve the breathability of an adhesive bra, the bra may include through openings, which pass through at least the cup member and the adhesive coating. For example, U.S. application Ser. No. 10/869,442 assigned to the same assignee herein, discloses a breathable adhesive bra comprising a transparent member including a clear adhesive layer, and a having a plurality of circular or oval through openings over the area of the transparent member. In addition, U.S. Patent Application Publication No. US 2003/0220048 discloses a breathable backsheet for a breast pad to be used with a bra in which the backsheet has a plurality of circular or non-circular openings.

While the through openings in the bra cup improve the breathability of adhesive bras, the formation of the openings through the cup member and the adhesive coating using conventional methods is difficult due to the shapes of the openings and the presence of the adhesive. In particular, when die cutting is used to form the openings in the adhesive bra, residue cut-outs adhere to the dies making the dies inoperable and difficult to clean. As a result, manufacturing adhesive bras with through openings becomes impracticable and costly.

It is, therefore, an object of the present invention to provide an adhesive bra with improved breathability so as to allow for greater comfort to the user's skin.

It is a further object of the invention to provide a breathable adhesive bra which is easy to manufacture.

SUMMARY OF THE INVENTION

In accordance with the principles of the present invention, the above and other objectives are realized in an adhesive bra element comprising a breathable member to be used as a bra cup and having a plurality of through openings over a predetermined area of the breathable member to provide breathability, wherein the through openings are formed as slit openings. The breathable member comprises a base layer and an adhesive layer disposed on a first surface of the base layer. Each of the slit openings can be an elongated single slit or a plurality of elongated slits which cross each other. The predetermined area of the breathable member can encompass the whole area of the breathable member or a part or parts of the whole area.

The adhesive bra element further comprises a backing layer affixed to the adhesive layer of the breathable member. The backing layer also includes a plurality of slit openings aligned with the slit openings in the breathable member and extending through the thickness, or a portion of the thickness, of the backing layer.

In the illustrative embodiment of the breathable member discussed herein below, the base layer of the breathable member comprises a thin and flexible material such as a plastic film, a woven fabric or a non-woven fabric. The adhesive layer, in turn, comprises a medical grade adhesive such as a non-sensitizing adhesive and the backing layer comprises coated paper.

An adhesive bra comprising two adhesive bra elements and a method of forming the adhesive bra elements are also disclosed.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
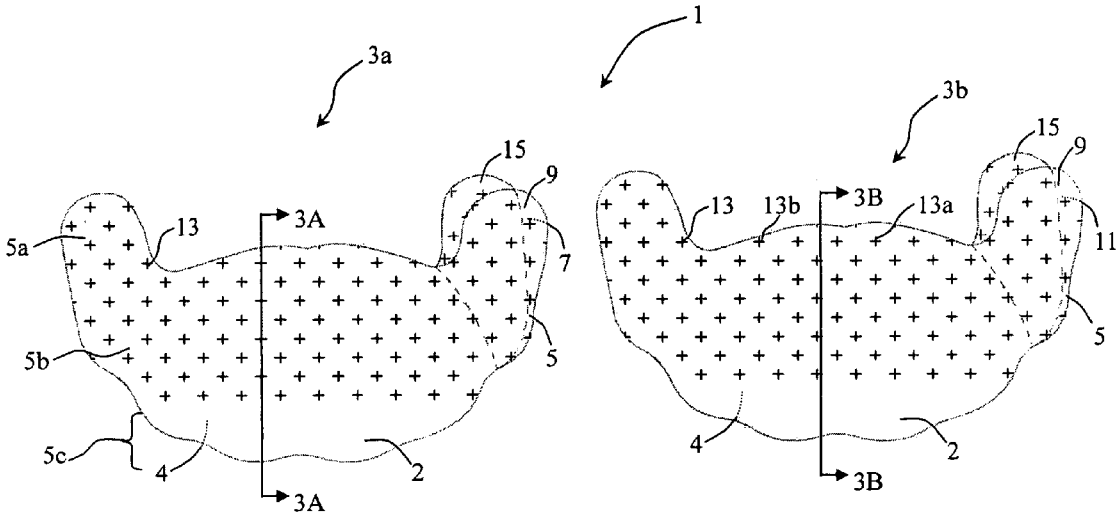
FIG. 1 shows a front view of a breathable adhesive bra in accordance with the present invention.
Figure 2:
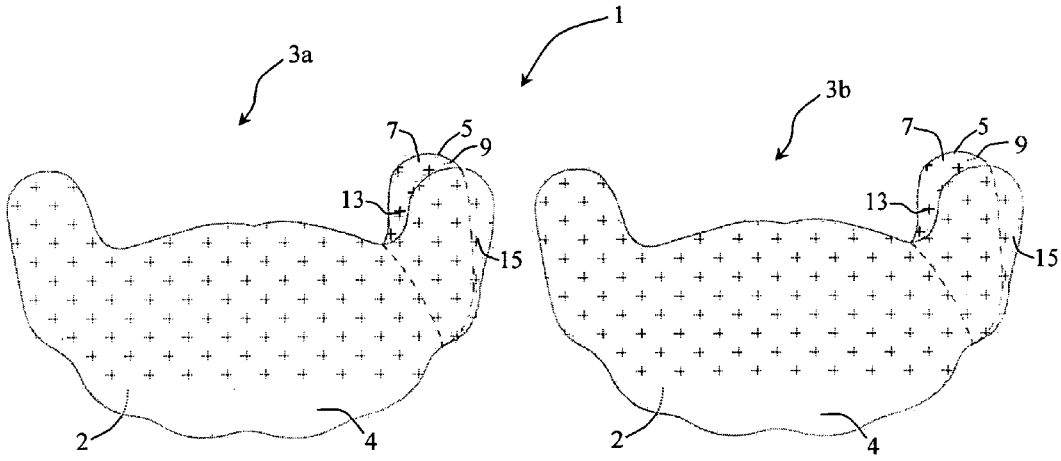
FIG. 2 shows a back view of the breathable adhesive bra of FIG. 1.

FIGS. 1-3B show a breathable adhesive bra 1 in accordance with the principles of the present invention. FIGS. 1 and 2 show a front view and a back view, respectively, of the bra 1 in an unworn state. As shown in FIGS. 1 and 2, the bra includes first and second symmetrical bra elements to be used as a right bra cup 3*a* and a left bra cup 3*b*.

In the illustrative case shown in FIGS. 1 and 2, the bra cups 3*a*, 3*b* have a shape which can be used with revealing and low-cut garments. However, it is understood that the shape and size of the cups 3*a*, 3*b* may vary and need not be as shown in FIGS. 1 and 2. For example, the cups 3*a*, 3*b* may have an oval or a petal shape, which are typically suitable for garments with plunging necklines. An example of another shape is shown in the aforementioned U.S. Pat. No. D485,965.

As also illustratively shown in FIGS. 1 and 2, the cups 3*a*, 3*b* are not connected to one another, allowing the user to apply each cup 3*a*, 3*b* individually and to adjust the application of each cup 3*a*, 3*b* according to the user's needs and breast shape. It is understood, however, that the cups 3*a*, 3*b* may be coupled to one another using a conventional fastening element.

Each bra cup 3*a*, 3*b* has a front surface 2, shown in more detail in FIG. 1, and a back surface 4, shown in more detail in FIG. 2. The back surface 4 of the bra cups 3*a*, 3*b* faces the user's breast.

Referring to FIGS. 1 and 2, each bra cup 3*a*, 3*b* of the bra comprises a breathable member 5 having one surface forming the front face 2 of the bra and an opposing surface 7. The breathable member 5 comprises a base layer 9 and an adhesive layer 11 disposed on the base layer 9 and forming the surface 7 of the breathable member 5.

In accord with the invention, the breathable member 5 also includes a plurality of slit openings 13 disposed over a predetermined surface area of the member 5. The slit openings 13 pass through the base layer 9 and the adhesive layer 11 of the breathable member so as to allow for air exchange between the user's skin to which the member is attached and the outside air. In this way, perspiration is allowed to evaporate from the user's skin when the bra 1 is worn. In addition, the slit openings 13 improve the elasticity, or the mechanical stretch, of the breathable member 5, which allows the member 5 to better mold to the user's breast. Accordingly, the bra 1 is made breathable and safer for the user.

As illustratively shown in FIGS. 1 and 2, each of the slit openings 13 is formed from a plurality of elongated slits 13*a* and 13*b* disposed to cross each other. In the case shown, the slits 13*a* and 13*b* of each slit opening 13 are situated vertically and horizontally, respectively, and cross each other orthogonally to form a cross-shape. However, the angle at which the slits 13*a* and 13*b* cross can vary to form other shapes. Additionally, each slit opening can be formed from only a single slit 13*a* or 13*b* or some of the slit openings 13 can be formed from crossing slits and others from a single slit. In any case, the slit openings 13 are such as to allow sufficient air exchange between the user's skin and the outside air.

The arrangement of the slit openings 13 over the surface area of the breathable member 5 may vary. In the illustrative case shown, the slits 13 are disposed over portions of the surface area of the member 5, including an upper portion 5*a* and a central portion 5*b* of the member 5, while the bottom portion 5*c* does not include any slit openings. This avoids compromising the mechanical strength of the member 5 in this area of the bra cup which may require added support for the user's breast. This arrangement is particularly useful where the base layer 9 of the breathable member 5 is formed from a thin microporous material or includes through apertures for additional breathability or design purposes. In other arrangements, if the member 5 has sufficient mechanical strength to provide adequate support for the user, the slit openings 13 may be disposed over the entire surface area of the breathable member 5.

As also illustratively shown in FIGS. 1 and 2, the slit openings 13 are disposed at approximately regular intervals from one another for manufacturing convenience. However, in other illustrative arrangements, the distance between the slit openings 13 may be varied depending on the breathability and support requirements of specific areas of the user's breast to which the member 5 is attached. In particular, the distance between the slit openings 13 is selected so as to provide sufficient breathability and elasticity without affecting the wearability and durability of the cup 3*a*, 3*b*. A usable distance range between the centers of the cross-shaped slit openings 13 shown in FIGS. 1 and 2 is between 0.5 and 1.0 inches, while a shorter distance between slit openings 13 may be used if each slit opening is formed from a single slit.

Figure 3A:
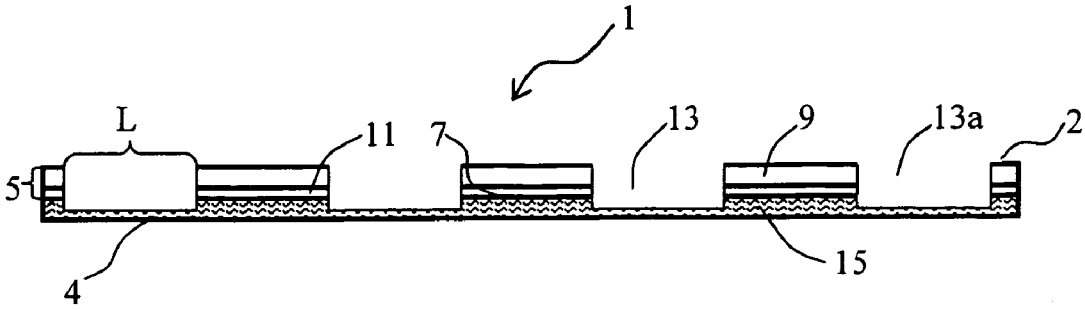
FIG. 3A shows a detailed cross-sectional view of the adhesive bra of FIGS. 1 and 2 taken along a line 3A-3A in FIG. 1.
Figure 3B:
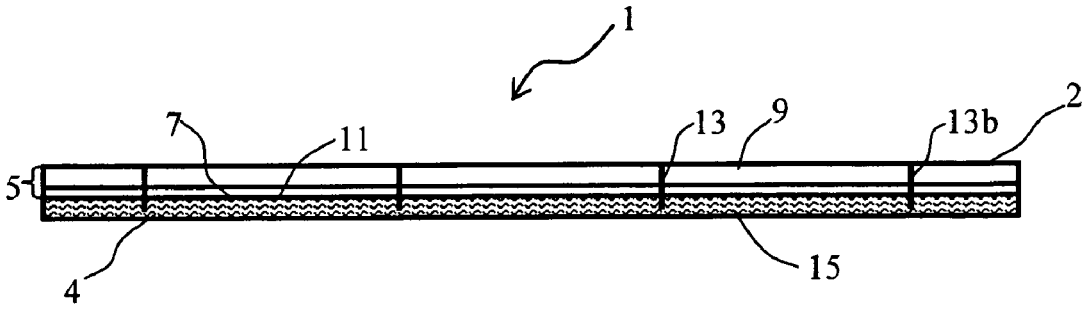
FIG. 3B shows a detailed cross-sectional view of the adhesive bra of FIGS. 1 and 2 taken along a line 3B-3B in FIG. 1.

As can be seen in FIGS. 1 and 2, each bra cup 3*a*, 3*b* also includes a backing layer 15, which is releasably affixed to the breathable member 5 via the adhesive layer 11. As shown in FIGS. 2, 3A and 3B, the backing layer 15 covers the entire inside surface 7 of the breathable member 5 and acts to protect the adhesive layer 11 from dirt and from drying out. The backing layer 15 is separated, or peeled off, from the breathable member 5, when using the respective bra cup 3*a*, 3*b*. This is shown in FIGS. 1 and 2, where a portion of the backing layer 15 has been separated from the breathable member 5 of each cup 3*a*, 3*b*. When the user separates the backing layer 15 from the breathable member 5, the adhesive layer 11 remains on the base layer 9 of the breathable member 5 so that the bra cup 3*a*, 3*b* can be applied and adhere to the user's skin.

FIGS. 3A and 3B show cross-sectional views of the bra cups 3*a* and 3*b*, taken along the lines 3A-3A and 3B-3B, respectively, in FIG. 1. In particular, the line 3A-3A extends through the centers of the cross-shaped slit openings 13 and is aligned with vertical slits portions 13*a*, while the line 3B-3B extends slightly displaced from the centers of the slit openings and crosses the slits 13*b*.

As shown more clearly in FIGS. 3A and 3B, the slit openings 13 extend through the breathable member 5 and into a portion of the thickness of the backing layer 15. Each of the vertical slits 13*a* shown in FIG. 3A has a length L. As can be seen in FIG. 1, the length of the vertical and horizontal slits 13*a* and 13*b* is approximately the same so that the length of the horizontal slits is also approximately L. A suitable dimension for the length L is about 0.25 inches.

As can be appreciated from FIG. 3B, the slits 13*a*, and 13*b* of the slit openings 13 are formed as incisions in the breathable member 5, without any loss of material and without formation of cut outs, or perforations, in the breathable member 5. As a result, the slit openings 13 provide additional elasticity or flexibility to the breathable member 5 and may be open when the breathable member of the cup 3*a*, 3*b* is adhered to the user's skin. The slit openings 13 thus not only improve the breathability of the cups 3*a*, 3*b* but also provide a better mold of the cup 3*a*, 3*b* to the user's breast.

Although FIGS. 3A and 3B show the slit openings 13 passing through a portion of the backing layer 15, it may be more convenient in manufacturing the bra cups 3*a*, 3*b* to form the slit openings 13 through all of the layers of the bra cup. Accordingly, in other arrangements of the invention, the slit openings 13 may pass through the entire thickness of the backing layer 15.

Figure 4:
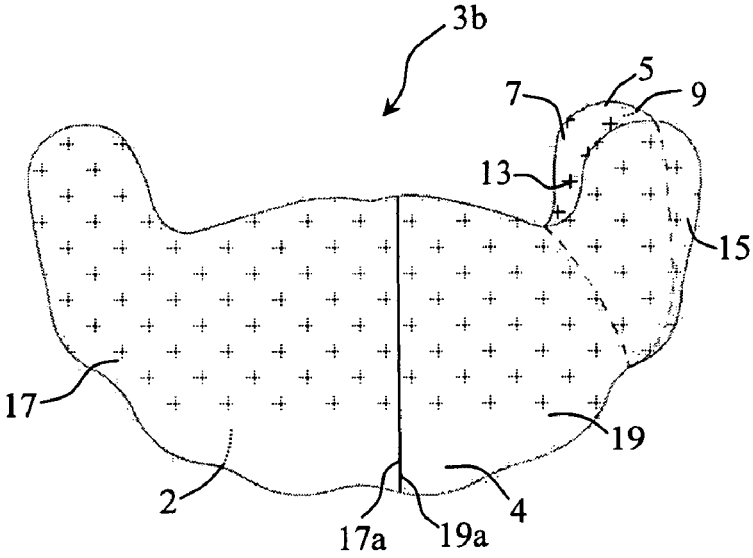
FIG. 4 is a back view of an alternative embodiment of one of the bra cups of the adhesive bra of FIG. 2.

FIG. 4 shows an alternative arrangement of the backing layer of each of the bra cups 3*a*, 3*b*. Although only one bra cup 3*b* is shown in FIG. 4, the arrangement of the bra cup 3*a* would be similar. As shown, the backing layer 15 includes two separated portions 17, 19 to assist the user in separating the backing layer 15 from the breathable member 5. Separation can be initiated simply by bending the bra cup 3*b*.

Also, in the illustrative case shown in FIG. 4, the portion 17 of the backing layer 15 is adjacent to the portion 19, such that a side 17*a* of the portion 17 borders a side 19*a* of the portion 19. In other arrangements, however, the portions 17 and 19 of the backing layer 15 may overlap to create flap portions which can be lifted by the user to initiate the separation of the backing layer 15 from the breathable member 5.

The base layer 9 of the breathable member 5 may be formed from a thin and flexible material, such as plastic film, woven or non-woven fabric. The thickness of the base layer 9 may vary depending on the size and shape of the bra and other variables. The preferred thickness of the base layer 9 is in the range between 0.005 and 0.010 inches. As mentioned above, the base layer 9 may include through openings or embossing over its surface area for additional breathability of the bra 1 or for ornamental purposes. The base layer 9 may be formed in a variety of colors or from a transparent or colorless materials.

The adhesive layer 11 of the breathable member 5 is non-irritating to the skin of the user and can be a medical grade adhesive. For example, a non-sensitizing adhesive or other conventional adhesive materials may be used as the adhesive layer 11. The adhesive layer 11 may be disposed over the entire surface of the base member 9, as shown in FIGS. 1 and 2 or, in the alternative, may be disposed over preselected portions of the surface of the base member 9.

The backing layer 15 of the bra 1 may be formed from a flexible material having a smooth surface. A suitable backing layer material may be a coated paper such as, for example, 78 pound release Kraft liner. The backing layer 15 adheres to the adhesive layer 11 which forms the surface 7 of the breathable member 5. The surface of the backing layer 15 allows the backing layer 15 to be peeled off or removed from the breathable member 5 to expose the adhesive layer 11 without removing the adhesive layer 11 from the base layer 9. Although the backing layer is shown in FIGS. 1 and 2 as being the same size and continuous with the breathable member, the backing member may also be of a different size and, in particular, may be larger than the breathable member.

An illustrative method of manufacturing the bra 1 shown in FIGS. 1-4 will now be described.

In manufacturing the bra 1 shown in FIGS. 1-4, a sheet of backing layer material is first coated with an adhesive to form the adhesive layer. A base layer material is then applied to the adhesive layer coating the backing layer by passing the base layer and the adhesively coated backing layer through a nip of a roller to form a substrate. The substrate thus formed comprises a backing layer, followed by an adhesive layer which is followed by a base layer. Alternatively, the substrate can be formed by applying the adhesive layer to the base layer first and then applying the backing layer to the adhesively coated base layer by passing the backing layer with the coated base layer through the nip of a roller. It is understood that these methods of forming the substrate are illustrative and that the substrate can be manufactured using various other processes.

Once the layered substrate comprising the backing layer, the adhesive layer and the base layer is formed, slit openings are then created over the predetermined surface area of the layered substrate. A suitable method for forming the slit openings 13 is a conventional die cutting process. The die cutting process produces die cuts in the form of the slit openings which preferably begin at the outer surface of the base layer and pass through the thickness of the base layer and the adhesive layer and partially through the thickness of the backing layer of the layered substrate. It is understood, however, that the die cuts may also pass through the thickness of all of the layers of the layered substrate, including the entire thickness of the backing layer 15.

As discussed above, the slit die cuts in the layered substrate may be formed in a variety of sizes and arrangements either over the entire surface area of the layered substrate or over pre-selected portions of the surface area of the substrate. The slit openings 13 shown in FIGS. 1-4 may be formed using the die cutting process over predetermined areas of the substrate such that, when one or more bra cups 3*a*, 3*b* are formed from the substrate in the next step, each bra cup includes slit openings over its the upper and central portions 5*a*, 5*b*, and no slit openings 13 are formed on the bottom portion 5*c* of each bra cup 3*a*, 3*b*. Each of the slit openings 13 thus formed has a cross-shape and comprises two slit portions 13*a*, 13*b* substantially perpendicular to one another.

The size of the slit openings may vary depending on the mechanical strength of the base layer and the size of the bra cup to be formed from the substrate, with a suitable slit opening length being in the range of approximately 0.125 to 0.1875 inches. Similarly, the distance between the slit openings may depend on a variety of factors, such as the strength of the base layer and the breathability and support requirements, with a suitable distance being in a range from about 0.25 and 1.0 inches.

Once the slit openings are formed in the layered substrate, the substrate can be cut into various shapes to form the cups 3*a*, 3*b* of the adhesive bra 1. Die cutting is the preferred method of cutting the bra cups 3*a*, 3*b* from the layered substrate. However, other well-known methods may be used to cut the substrate. Moreover, if it is desired that the backing layer for each bra cup be formed as separate portions as shown in FIG. 4, the substrate can be subjected to so-called "kiss cutting" from the backing layer side at appropriate locations to form the separate backing portions. As above-described, the shapes and sizes of the bra cups can vary depending upon the intended use of the bra, the user's breast size and other factors.

In another illustrative method of manufacturing the bra 1, the slit openings 13 may be created over the surface area of the substrate formed in the first step after forming the bra cups 3*a*, 3*b* from the substrate. After the bra cups 3*a*, 3*b* are formed from the substrate, the slit openings 13 can be formed over the predetermined surface of each bra cup 3*a*, 3*b* using the die cutting process or any other suitable conventional process.

In all cases it is understood that the above-described arrangements are merely illustrative of the many possible specific embodiments which represent applications of the present inventions. Numerous and varied other arrangements can be readily devised in accordance with the principles of the present invention without departing from the spirit and scope of the invention, as defined by the accompanying claims.

I claim:

1. An adhesive bra element comprising:

a breathable member to be used as a bra cup and having a plurality of through openings over a predetermined area of the breathable member to provide breathability, wherein said breathable member comprises a base layer and an adhesive layer disposed on a first surface of said base layer and said through openings are slit openings; and a backing layer affixed to said adhesive layer, said backing layer including a plurality of slit openings aligned with said through openings in the breathable member.

2. An adhesive bra element in accordance with claim 1, wherein each of said slit openings comprises one of a plurality of crossing slits and a single slit.

3. An adhesive bra element in accordance with claim 2, wherein said base layer comprises a thin and flexible material and said adhesive layer comprises a medical grade adhesive.

4. An adhesive bra element in accordance with claim 3, wherein:

said base layer comprises one of a plastic film, a woven fabric and a non-woven fabric, said adhesive layer comprises a non-sensitizing adhesive, and said backing layer comprises coated paper.

5. An adhesive bra element in accordance with claim 4, wherein said slit openings in said backing layer are through openings.

6. An adhesive bra element in accordance with claim 4, wherein said slit openings extend through a portion of a thickness of said backing layer.

7. An adhesive bra element in accordance with claim 4, wherein a size of said slit openings in said breathable member and said backing layer is between 0.125 to 0.1875 inches.

8. An adhesive bra element in accordance with claim 7, wherein said slit openings are cross-shaped slits and the distance between said cross-shaped slits is between 0.25 and 1.0 inches.

9. An adhesive bra element in accordance with claim 4, wherein said backing layer comprises a first portion and a second portion.

10. An adhesive bra element in accordance with claim 2, wherein said predetermined area of the breathable member is the whole area of said breathable member.

11. An adhesive bra element in accordance with claim 2, wherein said predetermined area of said breathable member comprises a central area of said breathable member and an upper area of said breathable member.

12. An adhesive bra comprising:

a first adhesive bra element comprising a first breathable member to be used as a first bra cup;

a second adhesive bra element comprising a second breathable member to be used as a second bra cup;

each of said first and second breathable members comprising a base layer and an adhesive layer disposed on a first surface of said base layer;

said first adhesive bra element further comprising a first backing layer affixed to said adhesive layer of said first breathable member and said second adhesive bra element further comprising a second backing layer affixed to said adhesive layer of said second breathable member;

wherein each of said first and second breathable members has a plurality of through openings over a predetermined area of that breathable member to provide breathability; and wherein said through openings are slit openings; and said first backing layer including a plurality of slit openings aligned with the through openings in the first breathable member and said second backing layer including a plurality of slit openings aligned with the through openings in the second breathable member.

13. An adhesive bra in accordance with claim 12, wherein each of said slit openings comprises one of a plurality of crossing slits and a single slit.

14. An adhesive bra in accordance with claim 13, wherein each said base layer comprises a thin flexible material and each said adhesive layer comprises a medical grade adhesive.

15. An adhesive bra in accordance with claim 14, wherein:

each said base layer comprises one of a plastic film, a woven fabric or a non-woven fabric, each said adhesive layer comprises a non-sensitizing adhesive, and each said backing layer comprises coated paper.

16. An adhesive bra in accordance with claim 13, wherein said slit openings in said first backing layer and said second backing layer are through openings.

17. An adhesive bra in accordance with claim 13, wherein said slit openings in each of said first backing layer and said second backing layer extend through a portion of a thickness of said backing layer.

18. An adhesive bra in accordance with claim 13, wherein a size of said slit openings in each of said breathable members and said backing layer is between 0.125 to 0.1875 inches.

19. An adhesive bra in accordance with claim 18, wherein said slit openings are cross-shaped slits and a distance between said slit openings is between 0.25 and 1.0 inches.

20. An adhesive bra in accordance with claim 13, wherein said first backing layer comprises a first portion and a second portion, and said second backing layer comprises a third portion and a fourth portion.

21. An adhesive bra in accordance with claim 13, wherein said predetermined area of each of said first and second breathable members is the whole area of each of said first and second breathable members.

22. An adhesive bra in accordance with claim 13, wherein said predetermined area of each of said first and second breathable members comprises a central area and an upper area of each of said first and second breathable members.

23. A method of forming a breathable adhesive bra element to be used as a bra cup comprising the steps of:

providing a breathable member comprising a base layer and an adhesive layer, wherein said providing the breathable member comprises providing said adhesive layer on a surface of one of a backing layer and the base layer and joining the other of said backing layer and said base layer to said adhesive layer;

forming a plurality of through openings as slit openings over a predetermined area of said breathable member to provide breathability, and forming a plurality of slit openings in the backing layer aligned with the through openings in the breathable member.

24. A method of forming an adhesive bra element in accordance with claim 23, wherein said forming the slit openings comprises die cutting said openings over the predetermined area of the breathable member.

25. A method of forming an adhesive bra element in accordance with claim 24, wherein each of said slit openings is formed as one of a plurality of crossing slits and a single slit.

26. A method of forming an adhesive bra element in accordance with claim 25, wherein said slit openings extend through a thickness of said base layer and said adhesive layer, and through at least a portion of a thickness of said backing layer.

27. A method of forming an adhesive bra element in accordance with claim 26, wherein said slit openings have a size between 0.125 to 10.1875 inches and wherein a distance between said slit openings is between 0.25 and 1.0 inches.

28. A method of forming an adhesive bra element in accordance with claim 27, wherein:

said base layer comprises one of a plastic film, a woven fabric and a non-woven fabric;

said adhesive layer comprises a non-sensitizing medical grade adhesive; and said backing layer comprises coated paper.

29. A method of forming an adhesive bra element in accordance with claim 25, further comprising cuffing said substrate in a shape of said bra cup.

* * * * *